US006540073B1

(12) United States Patent
Hagel et al.

(10) Patent No.: US 6,540,073 B1
(45) Date of Patent: Apr. 1, 2003

(54) SALES PACKAGING

(75) Inventors: Gerhard Hagel, Gaildorf (DE); Manfred Reinhardt, Feuchtwangen (DE); Dieter Helmut Schoenlein, Horn-Bad Meinberg (DE)

(73) Assignee: Hawera Probst GmbH, Ravensburg (DE)

( * ) Notice: Subject to any disclaimer, the term of this patent is extended or adjusted under 35 U.S.C. 154(b) by 0 days.

(21) Appl. No.: 09/720,293

(22) PCT Filed: Jun. 21, 1999

(86) PCT No.: PCT/DE99/01811

§ 371 (c)(1),
(2), (4) Date: Dec. 22, 2000

(87) PCT Pub. No.: WO99/67155

PCT Pub. Date: Dec. 29, 1999

(30) Foreign Application Priority Data

Jun. 22, 1998 (DE) ..... 198 27 748
Mar. 6, 1999 (DE) ..... 199 09 977

(51) Int. Cl.[7] ..... B65D 85/28

(52) U.S. Cl. ..... 206/379; 206/461; 206/471; 206/467; 53/427

(58) Field of Search ..... 206/379, 461, 206/471, 524.8; 53/453, 427, 509, 559

(56) References Cited

U.S. PATENT DOCUMENTS 2,931,495 A 4/1960 Stratton, Jr.
2,952,353 A 9/1960 Rohdin
3,399,763 A * 9/1968 Stone ..... 206/461
3,703,234 A * 11/1972 Howard ..... 206/379
4,200,193 A * 4/1980 Boyle ..... 206/461
4,324,331 A * 4/1982 Ignasiak ..... 206/363
4,537,011 A * 8/1985 Bortolani et al. ..... 53/509
5,082,112 A * 1/1992 Dunklee ..... 206/363

FOREIGN PATENT DOCUMENTS

| | | |
|---|---|---|
| AT | 294691 | 11/1971 |
| DE | 2 245 496 | 3/1974 |
| DE | 78 10 653 U1 | 7/1978 |
| EP | 0 106 930 A1 | 5/1984 |
| FR | 2 634 741 | 2/1990 |
| GB | 2 134 488 A | 8/1984 |

* cited by examiner

*Primary Examiner*—M. D. Patterson
*Assistant Examiner*—Jila M. Mohandesi
(74) *Attorney, Agent, or Firm*—Morgan, Lewis & Bockius LLP

(57) ABSTRACT

The invention relates to a sales pack for receiving one or more products having inherent stability, and in particular tools, with a protective packaging of plastic for at least partially receiving the product, the protective packaging being made in the form of a rigid film of plastic with its own stability, which hugs the outer contour of the product at least partially with a form fit—in the manner of a skin pack—and an additional rear covering of paper, paperboard, card, plastic or the like being joined to the rigid film of plastic. In this case, the covering (4) comprises only a subregion of the rear side of the rigid film of plastic (2).

28 Claims, 3 Drawing Sheets

SALES PACKAGING

BACKGROUND OF THE INVENTION

The invention relates to a sales pack and to a process for producing such a sales pack.

In packaging for products, a distinction is drawn between so-called skin packs and plastic rigid-film packs. The skin packs comprise a thin flexible film of plastic which shapes itself around the product when heat is generated, but at the same time has no inherent stability and therefore has to be stabilized with a special rear wall of card. The disadvantage of this pack is a negative image, since it is generally used for cheap consumer products. Furthermore, owing to the properties of the flexible film, it is often only possible to a slight extent for the product to be three-dimensionally captured. Finally, production requires special air-permeable product supports for applying negative pressure.

U.S. Pat. No. 2,931,495 discloses a pack in which the product is at least partially enclosed in a rigid film of plastic. In this case, during the production operation the rigid film of plastic is placed onto the product and shaped with a form fit around the product by means of heat and negative pressure. The advantage of this type of packaging is that the rigid film of plastic has inherent stability, so that it is possible to dispense with an additional label of paper, plastic or the like.

A disadvantage of this prior art is a design which does not envisage unauthorized removal of the product from the pack, since an additional card is merely applied to the upper side of the pack as a label. However, it is also envisaged to apply a covering on the underside of the rigid film, in order to close the opening completely. As evidenced by the description of this printed specification, it is envisaged that the required rigidity of the product by the relatively weakly formed film of plastic is only brought about by the additional card on the upper side or the underside.

There have also been disclosed plastic rigid-film packs (blister pack) in which, by means of an additional tool, the film of plastic is brought into a spatial form which does not correspond to the form of the product and into the interior of which the product is introduced. The rigid film may have lateral folds, into which a printed card is pushed in order to close the rear side of the pack. At the same time, the card has the required information. Securing of the card with respect to the rigid film is carried out, for example, by means of a staple or the like.

SUMMARY OF THE INVENTION

The invention is based on the object of proposing a pack, in particular for tools of all kinds, which represents a high-quality sales pack, which furthermore permits particularly good handling when the pack is opened and offers a high degree of security against theft. Altogether, good handling of the product is to be made possible and an environmentally compatible pack is to be provided.

Solution achieving the object and advantages of the invention:

Advantageous and expedient developments of the sales packs of the respective patent claims are presented in the subclaims.

The essential idea of the present invention is to create a sales pack by means of a rigid film of plastic which presents the product in an optimum way. On the basis of the production process, the rigid film of plastic is intended here to surround the product with a form fit in the manner of a "skin pack", so that the particular contour of the product is three-dimensionally reproduced. This serves for particularly advantageous sales presentation, in which the product is presented in its own form even within the pack. By using a transparent rigid film of plastic, a high degree of stability of the pack is achieved in the case of the present invention in comparison with a customary skin pack with a flexible film, since the rigid film itself has a carrying function of its own. As a result, it could in fact be possible to dispense with an additional carrier film or a carrier card, since the rigid film alone represents a complete pack. The rear covering additionally used according to the invention, such as for example card, paperboard, paper or film, is however used as an additional element for securing the product against unwanted or unauthorized removal, it being possible for this covering to be additionally used as an information carrier. According to the invention, the covering is applied only on a subregion of the rigid film of plastic, so that a further region comprises the rigid film of plastic alone, with its carrier properties. This has the advantage that the covering in these regions definitely ensures a closure secured against unwanted or unauthorized removal of the product, without a complete closure of the rear side by means of the covering being necessary. If only parts of the rigid film are closed with a corresponding covering, the removal of the product is made easier, since easier access to the interior of the pack is possible. Such a partial covering of the interior of the pack can accordingly perform the task of a tamper-proof closure, so that it is also possible for a guarantee to be protected, for example when the still unopened pack is returned. In any event, the pack or the product cannot be manipulated, since removal of the product always leads to the complete or at least partial destruction of the covering.

The region of the product pack not covered by the covering may be made to any size desired or varied, i.e. products of various sizes can be packed with a covering of the same size.

A not inconsiderable advantage is also the novel outer appearance of such a partial covering, which is always the same while the products differ, by means of a covering which only partially covers the rigid film. This covering may also be conceived as a trademark. The self-supporting properties of the rigid-film pack of course mean that the covering has the primary task of protection against theft, stopping simple removal, and a task as an information carrier. In particular, the covering may have additional factual or commercial information, additional company/brand names or other information which, for example, can be handled uniformly irrespective of the pack size. Additional labels of all kinds may also be printed on, adhesively attached or fastened in some other way.

The invention is also characterized by a production process, the pack being produced by the product to be packaged being placed into a receptacle or additional mold in a thermoforming or skin machine and by the heated rigid film subsequently being as it were thermoformed around the product with a form fit by means of a vacuum or compressed air or a vacuum and compressed air and without any additional tool. The rigid film hugs the product with a form fit. Subsequently, a covering, as described before, is applied on the rear side in such a way that a partial coverage of the rigid film takes place. The individual packs can be punched out from a sheet of film.

All rigid films of transparent, thermoformable plastic come into consideration as the material for the product packs, in particular PET (polyethylene terephthalate), PP (polypropylene), PVC (polyvinyl chloride) or PS (polystyrene). All materials, preferably those which can bear printing, come into consideration for the covering, in particular paper, paperboard, card or else films of plastic. A film of plastic which, for example, can bear printing and can be bonded to the rigid film of plastic by a suitable adhering, welding or sealing process also comes into consideration as the covering.

The sales pack according to the invention is suitable for packs of all kinds. It is particularly suitable for tools or tool accessories and in particular for elongate tools such as drills, chisels or sawblades, or else for tools such as hammers, screwdrivers or other elongate products. It is also suitable, however, for flat objects such as circular sawblades or the like.

The invention further provides that the high inherent rigidity of the pack and the associated carrying function can be brought about by means of suitable structural measures on the rigid film of plastic itself. For example, impressions in general and/or inscriptions taking the form of impressions are envisaged as information carriers, which additionally have the effect of stiffening the product pack. In this case, the rigid film of plastic may alone have all the required carrying properties and, if appropriate, itself convey the information required, so that the additionally applied covering merely serves for the security measures for the product and as an information carrier.

BRIEF DESCRIPTION OF THE DRAWINGS

Exemplary embodiments of the invention are explained in more detail in the following description and are represented in the drawing, in which.

DETAILED DESCRIPTION OF THE PREFERRED EMBODIMENT

Figure 1:
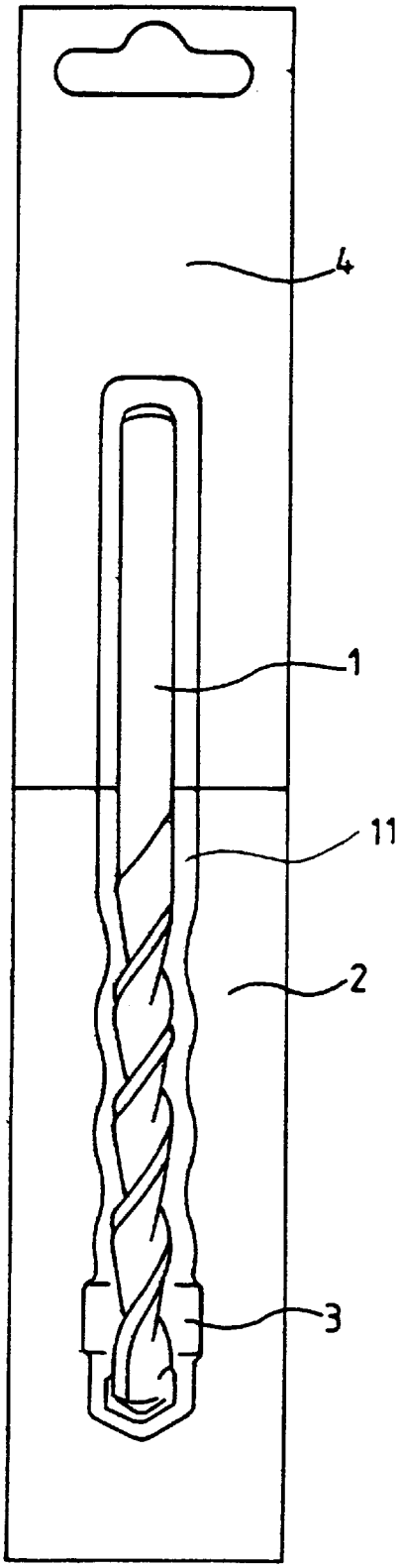
FIG. 1 shows a preferred configuration of a pack designed according to the invention in front view.
Figure 2:
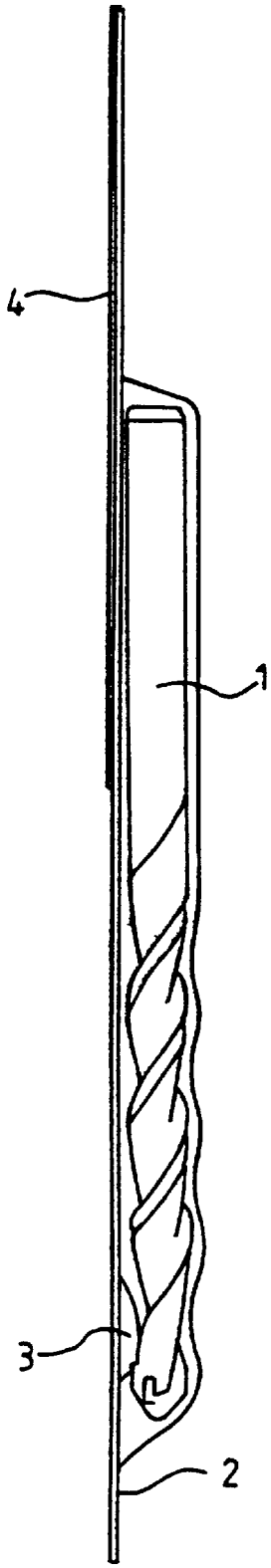
FIG. 2 shows a side view of the pack according to FIG. 1.
Figure 3:
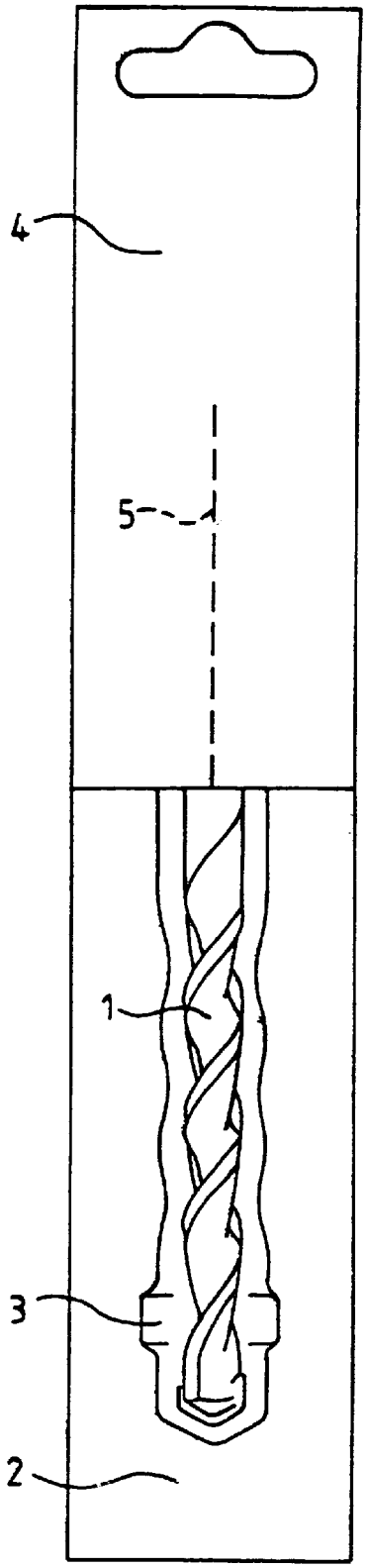
FIG. 3 shows a rear view of the pack according to FIGS. 1 and 2.

The sales pack according to invention is explained in more detail on the basis of the pack for a drilling tool. It goes without saying that other similar tools, such as chisels, elongate sawblades, or else differently formed tools, can also be accommodated in a pack of this type.

As can be seen from the representations in FIGS. 1 to 4, the sales pack preferably comprises a transparent rigid film of plastic thermoformed with a form fit and a printed covering, for example in the form of a printed card.

One or more products or tools 1 are placed into a receptacle or support of a thermoforming machine in a way similar to in the production of a skin pack. The rigid film of plastic 2 is placed on and heated and is thermoformed around the product by means of a vacuum or compressed air. The rigid film of plastic 2 thereby envelopes the product with a form fit, i.e. it closely hugs the outer contour of the product. For secure fixing of the product in the pack, the rigid film 2 is drawn in the heated state at least partially around the sides of the product over an angle of arc of more than 180°, preferably more than 200°. The desired draw-back can be achieved preferably by an additional spacer between the product and the drawing table and/or by a corresponding selection of the film material, the heating of the rigid film 2 and by setting the vacuum or/and the compressed air. The product may also be raised or lifted fully or partially off the support, in order to improve the "draw-back", i.e. to improve the way in which the product is enclosed to prevent falling out.

For additionally securing the product in the pack against falling out or for indicating unauthorized removal and for receiving inscription and marking, a printed covering 4 is adhesively attached over a subarea to the rear side of the rigid film of plastic or a printed film of plastic 4 is welded, adhesively bonded or sealed to the rigid film 2. In this case, the same plastic can be used for producing a monomaterial pack.

Standard inscriptions which are, for example, repeated on every pack, such as for example specifying the material, recycling designations etc., can be integrated in the table of the thermoforming machine as an elevation or depression and are consequently already provided in the thermoforming operation as embossing type on the rigid film 2.

For removal of the product, from the pack the rear covering is preferably provided with a perforation 5.

For further retention, the product may be secured on the side facing away from the partial covering 4 by an enlarged draw-back. Alternatively, a second partial covering 6 is used for securing the product in the pack.

Figure 4:
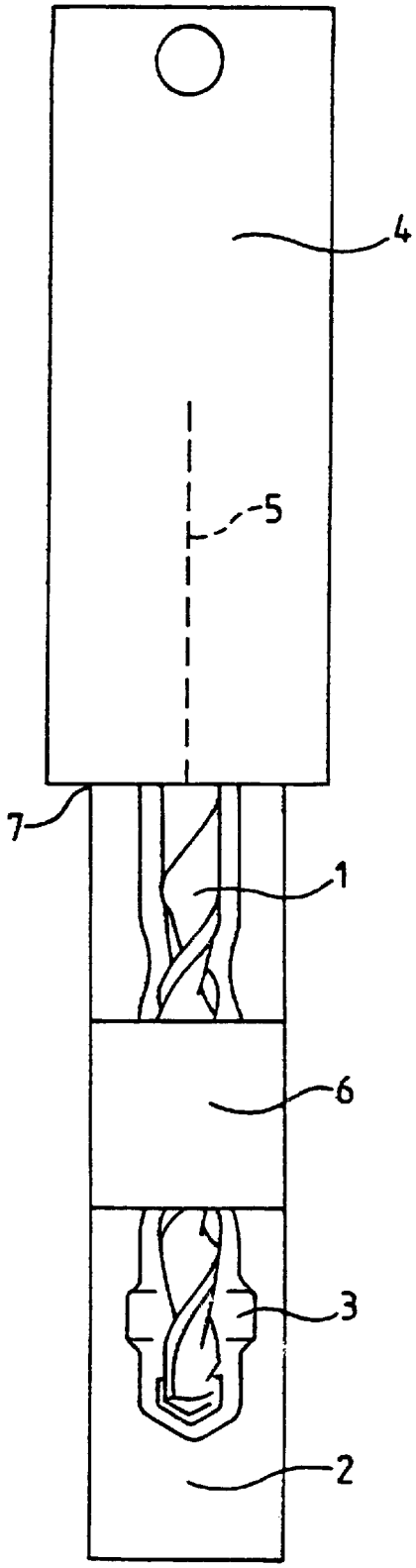
FIG. 4 shows a further variant of the pack designed according to the invention in rear view.

Preferably, part of the rigid film 2 can be saved by the packs being produced offset in relation to one another, i.e. with a lateral offset 7, according to the representation in FIG. 4. The covering 4 is consequently produced in such a way that it is widened with respect to the rigid film 2.

In the figures, the covering 4 is only symbolically represented as an information carrier. It may contain information on applications or about the article, price details, instructions for use, indications of the company, such as a company logo, name, trademark or the like. Information 8 may in this case also be impressed directly into the rigid film 2 and, if appropriate, may also be provided with a color background (see FIG. 5*a*). This has the advantage that this region is additionally strengthened and stiffened on account of the deformation. As a result, even thinner rigid films 2 can be used, without the stability of the pack suffering overall.

Labels of any kind, such as price labels, barcodes etc., may also be adhesively attached, printed on or applied in some other way.

Figure 5A:
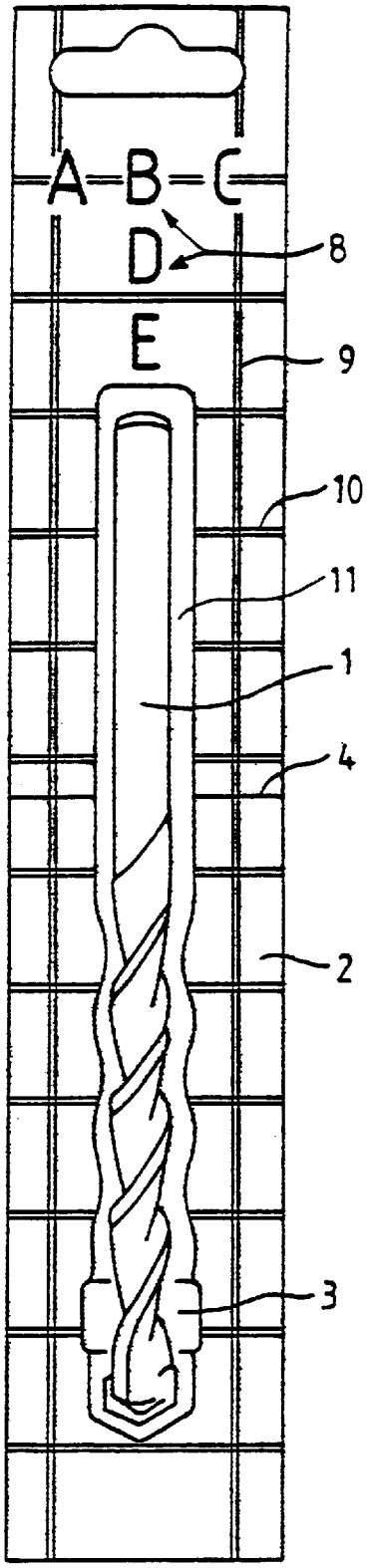
FIG. 5*a* shows a further variant of the pack according to the invention with stiffening elements and FIG. 5*b* shows a side view of the pack according to FIG. 5*a*.
Figure 5B:
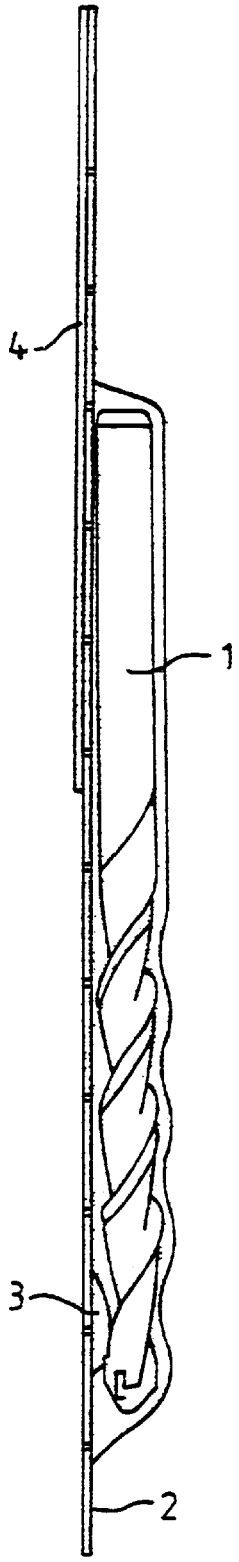

In the exemplary embodiment according to FIGS. 5*a*, 5*b*, the rigid film of plastic 2 is stiffened by additional longitudinal impressions 9 and/or transverse impressions 10. These are longitudinal grooves 9 or transverse grooves 10, which preferably extend over the entire length and/or the entire width of the pack. In the region of the viewing window 11 for the product 1, impressions have been omitted, however, for a better visual design.

The product pack can be strengthened still further by these shaping-related measures. The use of additional stiffening means provided by the cover is therefore not required for the strength of the pack. Nevertheless, the thickness of the rigid film, impressions and partial covering are adjusted with respect to one another in order to obtain the overall strength.

According to the exemplary embodiments shown in FIGS. 5*a*, 5*b*, the pack is accordingly configured with an additional partial covering 4, which is applied to the rear side of the upper half of the rigid film 2. On account of the above measures, this covering 4 can be made extremely thin, since the covering itself does not in fact have any, or only slight, stiffening properties. Rather, this is additionally accomplished by the impressions 9, 10 in the rigid film 2. In the case of all the exemplary embodiments with an additional partial covering 4, the information 8 can of course also be applied to the covering itself and not to the rigid film 2. Alternatively, the rigid film 2 itself bears the corresponding information. In this case, the covering to be applied serves primarily for additionally securing the product against unwanted or unauthorized removal.

In comparison with a conventional "skin pack", there is no expensive air-permeable special card as a stiffening underlay for the flexible film, since the rigid film itself assumes the carrying properties. However, it would also be possible to proceed in a way similar to in the production of skin packs with a flexible film, but using a rigid film of plastic with the advantages associated with it. The "partial covering" of the invention may accordingly be applied by the thermoforming operation or in conjunction with the thermoforming operation.

The rigid film 2 may be made such that it is transparent entirely or partially and in particular in the region of the viewing window, or else colored. Parts may, however, also be made opaque.

By adapting the materials to one another and in particular by selection of the same or adapted grades of plastic for all the parts of the pack, an environmentally harmless pack is created.

The invention is not restricted to the exemplary embodiments represented and described. Rather, it also comprises all variants within the scope of the patent claims.

We claim:

1. A sales pack for receiving at least one product having inherent stability, and in particular tools, comprising:

a protective packaging of plastic for at least partially receiving the at least one product, the protective packaging being made of a rigid film of plastic having a stable structural form adapted to hug an outer contour of the at least one product at least partially with a form fit; and a rear covering being joined to the rigid film of plastic such that a portion of a rear side of the rigid film of plastic remains exposed, the covering covers 1/10 to 9/10 of an opening in the rigid film of plastic for removal of the at least one product.

2. The sales pack according to claim 1, wherein the covering comprises an inscribed covering and the rigid film is joined to the inscribed covering in such a way that the at least one product can be removed from the sales pack only by an at least partial destruction of the covering.

3. The sales pack according to claim 1, wherein inherent stability of the rigid film of plastic and stability of the covering are adapted to one another in such a way that the rigid film of plastic is made as thin as possible.

4. The sales pack according to claim 1, wherein the rigid film of plastic is produced for products of different sizes or lengths, a standard covering being provided for a number of sizes or lengths.

5. The sales pack according to 1, wherein the covering is additionally designed as an information carrier for information.

6. The sales pack according to claim 1, wherein the covering is provided with a perforation for removal of the at least one product.

7. The sales pack according to claim 1, wherein information is applied on the rigid film of plastic by a printing process.

8. The sales pack according to claim 1, wherein the covering is of a multi-part form, part of the covering being joined releasably and re-attachably to the rigid film of plastic and another part of the covering being removable from the rigid film of plastic only by means of destruction.

9. The sales pack according to claim 1, wherein stiffenings in the form of one or more embossings are made in the rigid film of plastic, at least in some regions of the rigid film of plastic surface, and are preferably provided in regions of the surface area of the rigid film which does not hinder viewing the product.

10. The sales pack according to claim 9, wherein an inscription is made, or some other information provided, in the rigid film of plastic by means of an impression, the impression or inscription preferably being applied directly on the rigid film of plastic in a printing process.

11. The sales pack according to claim 10, wherein the impression takes place by a longitudinal and/or transverse channelling.

12. The sales pack according to claim 10, wherein the impression for stiffening the surface is formed at least partly as an inscription or other information carrier, for example company logos, in multiple series up against one other and/or alongside one another.

13. The sales pack according to claim 1, wherein rigid film of plastic comprises an impression extending over a surface of the rigid film of plastic and the impression includes pyramidal formations.

14. The sales pack according claim 1, wherein the rigid film of plastic is formed to be at least partly transparent and in particular transparent in a region of a viewing window for the at least one product, subregions in particular being formed such that they are colored.

15. The sales pack according to claim 1, wherein the covering is formed from plastic and in particular from the same grade of plastic as the rigid film of plastic.

16. A process for the production of a pack according to claim 1, wherein the at least one product to be packed is placed in a receptacle of a thermoforming or skin machine without a separate tool, and subsequently a heated rigid film of plastic is thermoformed around the product with a form fit by means of a vacuum, the rigid film of plastic completely hugging the outer contour of the product over a portion of the product.

17. The process according to claim 16, wherein the rigid film of plastic encloses the at least one product over an angle of arc of greater than 180° in order to retain the product.

18. The process according to claim 16, wherein the covering comprises at least one of paper, paperboard, card, and plastic.

19. The process according to claim 16, wherein the at least one product is positioned such that it is raised or lifted fully or partially off the support, to improve the way in which the at least one product is enclosed by the rigid film of plastic.

20. The process according to claim 16, wherein, following the thermoforming operation, the covering is welded, adhesively bonded or joined well in some other way to the rigid film of plastic.

21. The process according to claim 16, wherein the covering is applied by the thermoforming operation or in conjunction with the thermoforming operation.

22. A process according to claim 1, wherein rigid film of plastic can be saved to the extent that it is produced offset and is arranged with an offset in such a way as to save film.

23. The sales pack according to claim 1, wherein the additional rear covering is made of at least one of paper, paperboard, card, and plastic.

24. The sales pack according to claim 1, wherein the rigid film of plastic comprises corrugated formations extending over a surface of the rigid film of plastic.

25. The sales pack according to claim 1, wherein the rigid film of plastic comprises spherical formations extending over a surface of the rigid film of plastic.

26. The sales pack according to claim 1, wherein the rigid film of plastic comprises a flat pattern extending over a surface of the rigid film of plastic.

27. A process particularly for the production of a pack according to claim 1, wherein the at least one product to be packed is placed in a receptacle of a thermoforming or skin machine without a separate tool, and subsequently a heated rigid film of plastic is thermoformed around the product with a form fit by means of compressed air, the rigid film of plastic completely hugging the outer contour of the product over a portion of the product.

28. A process particularly for the production of a pack according to claim 1, wherein the at least one product to be packed is placed in a receptacle of a thermoforming or skin machine without a separate tool, and subsequently a heated rigid film of plastic is thermoformed around the product with a form fit by means of a vacuum and compressed air, the rigid film of plastic completely hugging the outer contour of the product over a portion of the product.

* * * * *